United States Patent [19]

Bisbing

[11] Patent Number: 4,556,244

[45] Date of Patent: Dec. 3, 1985

[54] LATCH ASSEMBLY HAVING PULL-UP ACTION

[75] Inventor: Robert H. Bisbing, Springfield, Pa.

[73] Assignee: Southco, Inc., Concordville, Pa.

[21] Appl. No.: 574,041

[22] Filed: Jan. 26, 1984

[51] Int. Cl.[4] ..... E05C 5/02

[52] U.S. Cl. ..... 292/65; 292/336.3

[58] Field of Search ..... 292/65, 67, 63, 57, 292/58, 69, 62, 59, 241, 242, 182, 336.3

[56] References Cited

U.S. PATENT DOCUMENTS

| | | | |
|---|---|---|---|
| 1,907,625 | 5/1933 | Vogt | 292/62 X |
| 3,111,833 | 11/1963 | Dettmer | 292/242 X |
| 3,208,782 | 9/1965 | Zeller | 292/62 X |
| 3,397,000 | 8/1968 | Nakanishi | 292/62 X |
| 3,510,154 | 5/1970 | Sheff | 292/67 X |
| 3,907,348 | 9/1975 | Bates et al. | 292/241 X |

*Primary Examiner*—Richard E. Moore

*Attorney, Agent, or Firm*—Paul & Paul

[57] ABSTRACT

A latch of the pull-up type for a cabinet door is latched and unlatched by turning the latch handle in one direction or the other. When the door is in latched position, rotating the latch handle in the unlatching direction initially causes a spring-biased shaft, which carries a latching pawl, to move axially inwardly. This inward movement of the shaft is permitted because a cam in the handle is moved rotationally to present downwardly sloping cam surfaces to opposite ends of a cam-follower pin which is mounted on the shaft near its outer end. The shaft is prevented from rotating on its own axis until a motion-control cross pin, which is also mounted on the shaft, is moved inwardly a sufficient distance to escape from axial motion-control slots in a support sleeve which is mounted on the door at an opening therein and through which the shaft passes. As soon as the motion-control pin emerges from the motion-control slots, it is able to move laterally into lateral arcuate motion-control recesses in the support sleeve, thereby to allow the shaft and the latch pawl to turn out of the way of the cabinet frame. To latch the door, the action described takes place in reverse order.

23 Claims, 9 Drawing Figures

LATCH ASSEMBLY HAVING PULL-UP ACTION

BACKGROUND OF THE INVENTION

This invention relates to door or panel latches for cabinets and the like. The latch is of the type adapted to be mounted along the edge of the door which overlaps the cabinet frame. The latch has a latching finger or pawl which is swingable over the inside of the cabinet frame at the door opening to lock the door against the cabinet frame by a pull-up action.

Pull-up latches of the foregoing type are disclosed in Barry et al U.S. Pat. No. 2,860,904, Barry U.S. Pat. No. 3,302,964 and Barry U.S. Pat. No. 3,402,958.

The pull-up latches shown in the above-identified U.S. patents may be characterized as lift-and-turn latches. One of the disadvantages of the lift-and-turn latches of the type shown in the first two patents, i.e., U.S. Pat. Nos. 2,860,904 and 3,302,964, is that it is possible when opening the latch to turn the handle before lifting it, and, conversely, when latching, it is possible to push the handle down before turning it. These possibilities can cause problems.

The last of the above three patents, namely, U.S. Pat. No. 3,402,958, represents an improvement over the lift-and-turn latches of the earlier two patents in that, in the later U.S. Pat. No. 3,402,958, extensions are provided on the sides of the handle. These extensions enclose the square head of a sleeve, thereby to prevent rotation of the handle when in the DOWN or locked position. However, provided sufficient torque force is applied, it is possible to break the extensions off the handle by turning it before lifting it. When the handle is in the UP or opening position, cooperating surfaces on the handle and sleeve provide a detent action. Even with these improvements, it is still possible to latch the fastener with the pawl in the wrong position.

SUMMARY OF THE PRESENT INVENTION

A principal object of the present invention is to provide a latch of the pull-up type which represents an improvement over the latches shown in the three U.S. patents identified above.

A more specific object is to provide a latch of the pull-up type in which the clamping action is accomplished by means of a single turning motion, in contrast to the two-step lift-and-turn motion of the prior art latches.

The foregoing specific object is accomplished by a latch mechanism which includes a motion-control pin mounted on and carried by the shaft which also carries the latching pawl, and by two intersecting motion-control slots or recesses one of which is axial and the other of which is lateral. When the motion-control pin is in the axial slot, only axial movement of the latching pawl is possible. When the motion-control pin is in the lateral recess, only angular movement of the latching pawl is possible. The structural arrangement is such that during a single continuous turning motion of the latch handle, the control pin transfers from one of the motion-control slots to the other, thereby to achieve, in sequence, during unlatching, axial and then angular movement of the latching pawl, and to achieve, in sequence, during latching, angular and then axial movement of the latching pawl. The sequential steps may, however, be reversed by modifying the latch structure.

Figure 7:
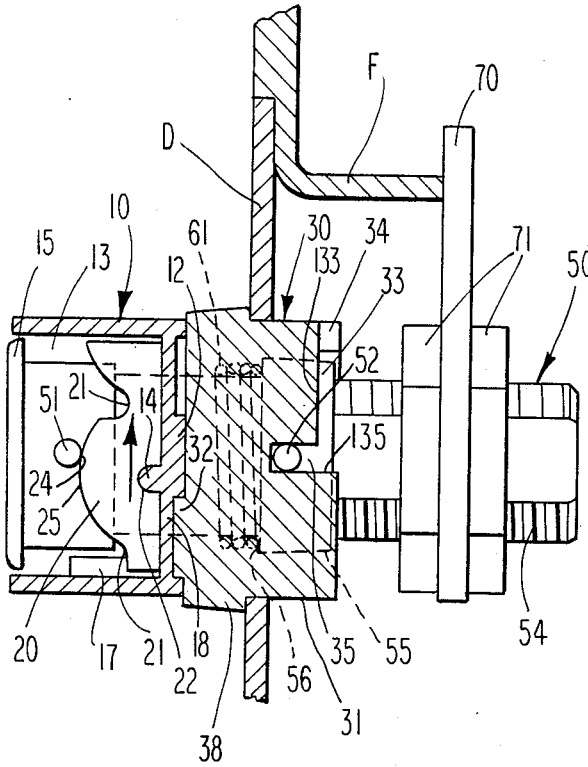
FIG. 7 is a diagrammatic view showing the pull-up latch mounted on the door of the cabinet and in fully latched position.
Figure 8:
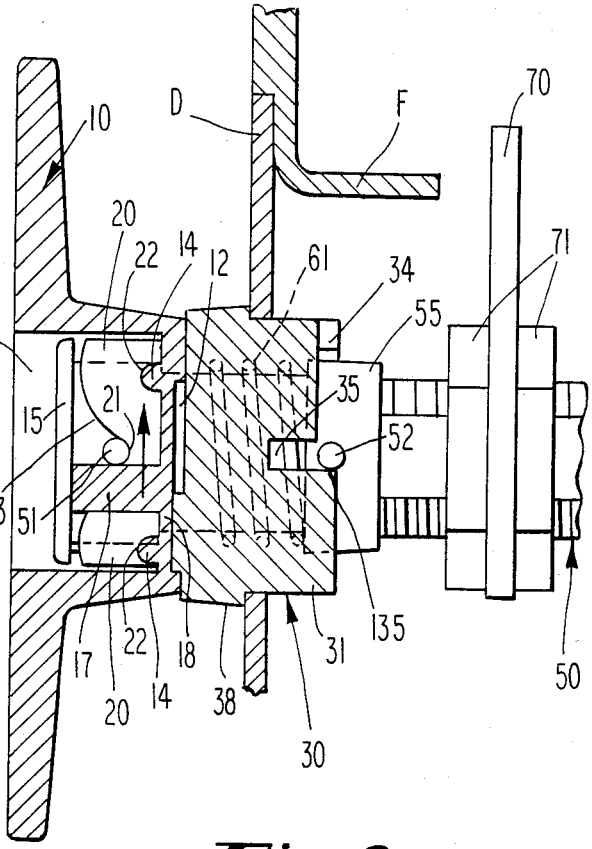
FIG. 8 is a diagrammatic view similar to that of FIG. 7 but showing the latch in partly unlatched position.
Figure 9:
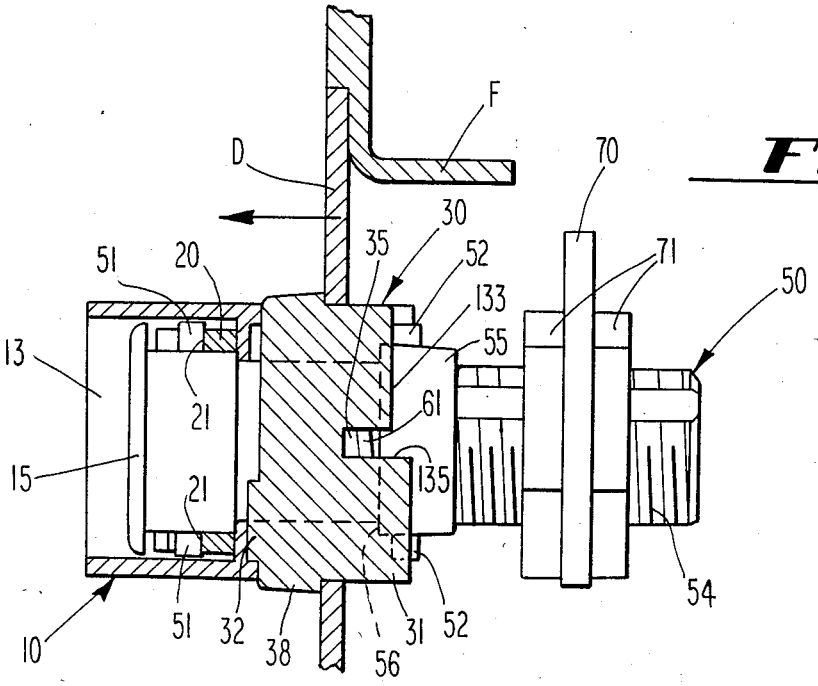
FIG. 9 is a view similar to that of FIGS. 7 and 8 but showing the latch in fully unlatched position.

It should be mentioned that the diagrammatic views in FIGS. 7, 8 and 9 have been purposely distorted, i.e., the cylindrical cam is stretched out, in order to show and describe more clearly the operation of the latch.

DETAILED DESCRIPTION OF THE PREFERRED EMBODIMENTS

The major components of the pull-up latch of the present invention are a handle 10, an annular or ring-like cam 20, a latch body 30 having an axial motion-control slot 35 and a lateral motion-control recess 33, and a shaft 50 which carries a latch pawl 70, a cam-follower pin 51 and a motion-control pin 52.

In the drawing, handle 10 is shown to be T-shaped. A T-shaped handle is best suited to the 180° rotation which has been designed into the latch of the present application. However, within the broad concept of the invention, the handle could have other shapes. For example, the handle could be L-shaped, or even a round knob. Nevertheless, a T-shaped handle is preferred, since it is obvious that more torque can be applied to a T-shaped handle than can be applied, for example, to a round knob.

The T-shaped handle 10 has a hollow cylindrical portion 11 which projects inwardly and defines a cavity 13. Movable within cavity 13 is a cap 15 which could be an integral part of shaft 50, but which in the drawing which fits over the head end of shaft 50 and is pinned thereto by a first cross pin 51 which projects laterally from the shaft 50 in both directions. However, the principal function of pin 51 is that of a cam follower.

In the present application, cam 20 is described as a separate element. It is preferably annular or ring-like, having a cam surface at its outer end. Cam 20 is preferably made of hardened steel to improve its strength and wear resistance. With some sacrifice in these qualities, the cam could be eliminated as a separate element and the cam surfaces could be cast as an integral part of cavity 13 of handle 10. In a preferred form, the cam surface has a pair of high points 25, a pair of low points or seats 21, and sloping surfaces therebetween. The high points 25 are spaced 180° apart, and so are the low points or seats 21. The sloping surfaces rise steeply on each side of the seats 21. A preferred shape for the cam surface is illustrated in the drawings.

The ring-like cam 20 is discontinuous. It has a gap which receives a projection 17 which is an integral part of handle 10, whereby the cam and handle are interlocked together for simultaneous rotational movement. In addition, cam 20 is also provided with notches 22 into which lugs 14 of handle 10 project to serve as additional interlocking elements.

The handle 10 has an arcuate sector 12 which projects inwardly from its base 18 and which is adapted, when handle 10 is rotated, to abut against an outward arcuate projection 32 of the latch body 30. This is seen most clearly in FIG. 4 where it is seen that if handle 10 is rotated 180° counterclockwise from the position shown, the left edge of the arcuate sector 12 of handle 10 will come into engagement with, and abut against, the edge of the arcuate projection 32 of the latch body 30.

The latch body 30 is a generally hollow cylindrical component which is mounted, as by screws 56, on the door D of the cabinet. An outer portion 38 is on the outside of the door D, while a sleeve portion 31 projects inwardly through a hole or opening in door D. As already mentioned, the outer end of latch body 30 has an outward arcuate projection or sector 32 which is adapted, when handle 10 is rotated, to be engaged by an inward arcuate projection or sector 12 on the handle 10.

Sleeve 31 of the latch body 30 is provided with a pair of axial motion-control slots 35, spaced 180° apart. Sleeve 31 is also provided with a pair of laterally extending sector-shaped motion-control recesses 33, spaced 180° apart. The motion-control slots 35 and recesses 33 receive in sequence, in one order or the other, the motion-control cross pin 52, as will be described.

Shaft 50 is an elongated shaft, the outer or head end of which is received within the cavity 13 of handle 10 and over which cap 15 is fitted. Shaft 50 projects inwardly through the cavity in the outer portion 38 of latch body 30, through the cavity of sleeve 31, and beyond, with the shaft so supported that the center axis of the shaft coincides with the center axis of sleeve 31. The inner end 54 of shaft 50 is threaded, and thereon is mounted a latching pawl 70, with the position of the pawl on the shaft being axially adjustable. The pawl 70 is held in place by a pair of nuts 71.

Mounted on shaft 50 at the location of sleeve 31 of latch body 30 is a bushing 55. The purpose of bushing 55 is to support the shaft 50 squarely within the latch body 30. Without it, the shaft 50 would tend to tilt severely in response to the eccentric loading produced by the pawl 70. Bushing 55 is tapered to a greater extent than the hole or cavity in latch body 30 into which the bushing fits, thereby to maximize the length over which shaft 50 is supported. The length of the support is the distance from the front end of the latch body 30 to the back end of the bushing 55. If an eccentrically loaded shaft, such as shaft 50, is not supported over a sufficient length, the shaft can hang up due to friction and would then stay in the latched position when the fastener is unlatched. However, the length of the support designed into the pull-up latch of the present application is sufficient to prevent such hang-up.

As already indicated, shaft 50 carries a first cross pin 51 which is utilized to pin cap 15 to the head end of shaft 50 but the principal function of pin 51 is as a cam follower.

Embracing shaft 50, and bearing at one end against a washer, O-ring seal and a shoulder 36 within the cavity of latch body 30, and bearing at the other end against the bushing 55, is a compression spring 61 which biases shaft 50 inwardly toward the unlatching position. This biasing maintains the cross pin 51 in close contact with the cam surface of cam 20, thereby allowing pin 51 to function as a cam follower.

Carried by shaft 50, and projecting laterally therefrom in both directions, at the location of bushing 55 is a second cross pin 52. This pin 52 is utilized to secure bushing 55 to the shaft 50. However, its principal function is that of motion control. It controls whether, in response to rotation of the latch handle, shaft 50 and pawl 70 will move only axially or only angularly. This is determined by whether the opposite ends of pin 52 are within the axial motion-control slots 35 or in the lateral motion-control recesses 33.

Operation

Figure 1:
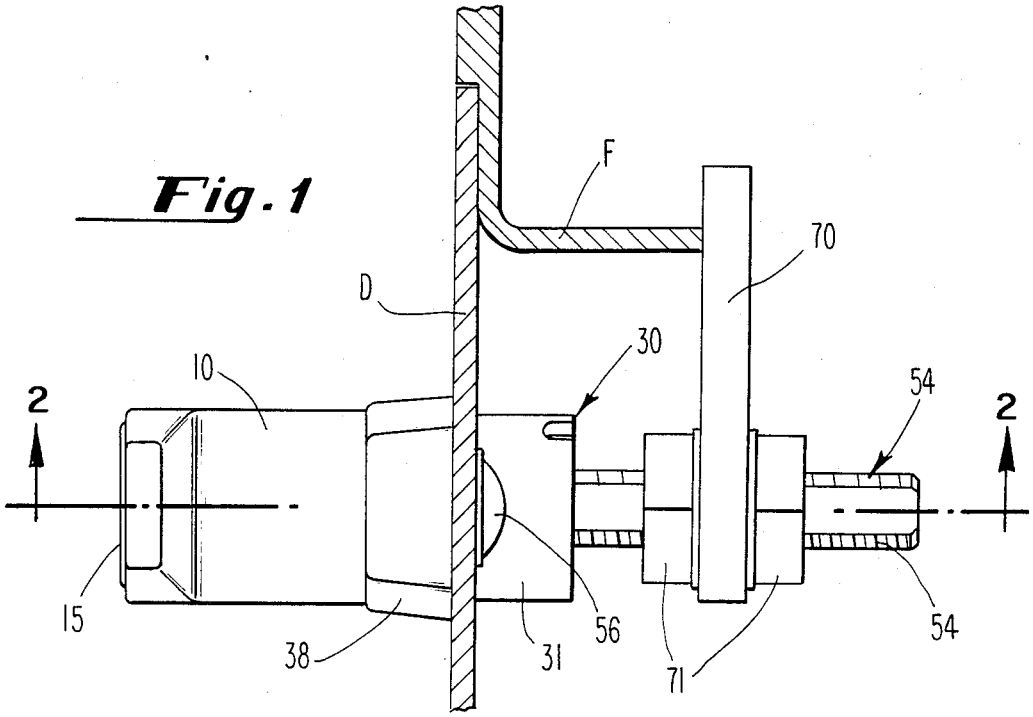
FIG. 1 is a top plan view of the new pull-up latch shown mounted on the door of the cabinet and in fully latched position.
Figure 2:
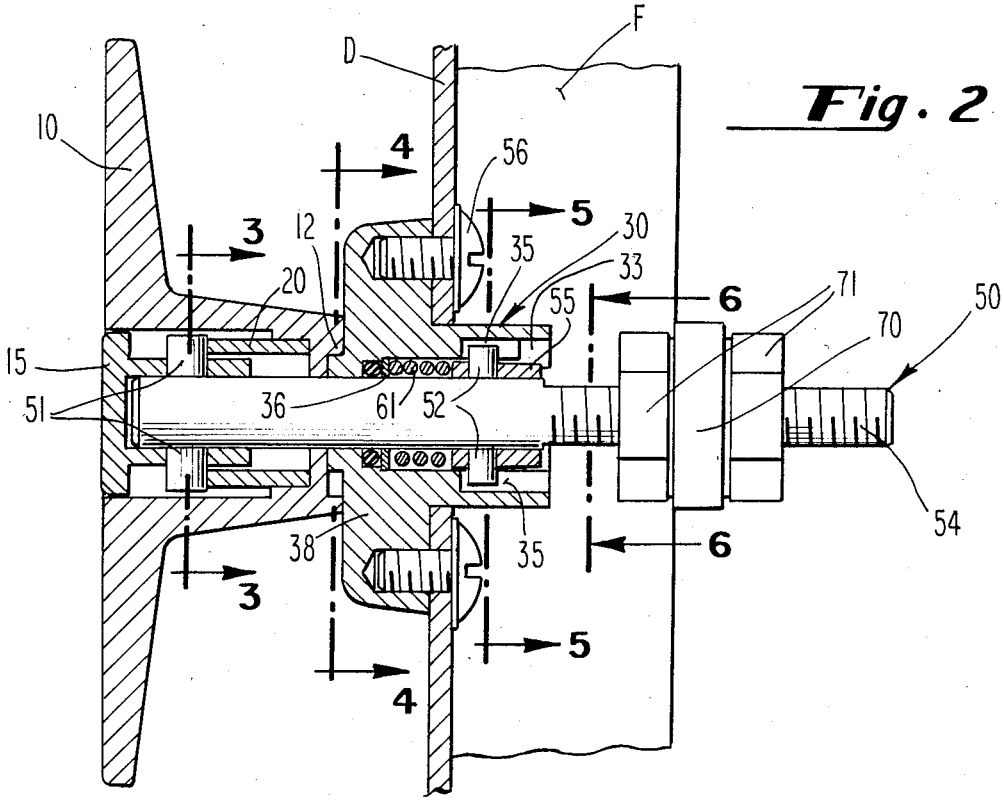
FIG. 2 is an elevational view, in section, looking along the line 2—2 of FIG. 1.
Figure 3:
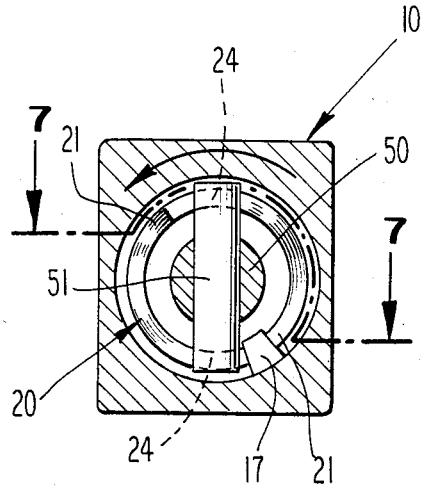
FIG. 3 is a view, in section, looking inwardly along the line 3—3 of FIG. 2.
Figure 4:
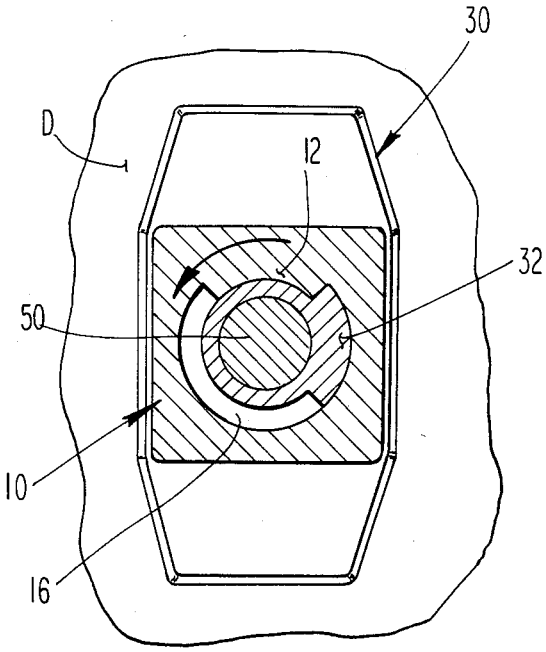
FIG. 4 is a view, in section, looking inwardly along the line 4—4 of FIG. 2.
Figure 5:
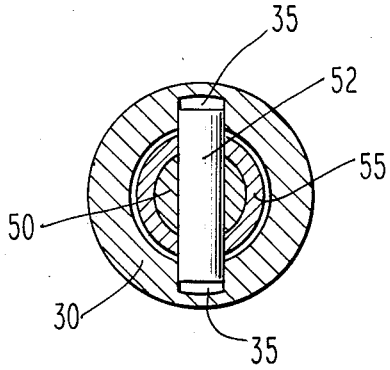
FIG. 5 is a view, in section, looking inwardly along the line 5—5 of FIG. 2.
Figure 6:
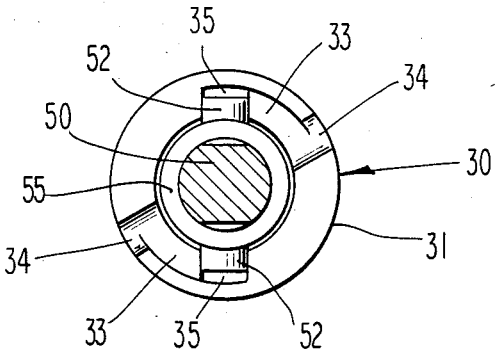
FIG. 6 is a view, in section, looking outwardly along the line 6—6 of FIG. 2.

As seen best in FIG. 4, relative rotation of handle 10 with respect to the latch body 30 is limited to 180° by the abutment of arcuate sector 12 of the handle 10 against the arcuate sector 32 of the latch body 30. For, as seen in FIG. 4, after sector 12 of the handle is rotated 180° counter-clockwise through open space 16, the left edge of sector 12 comes into contact with the lower edge of sector 32 of the latch body.

FIG. 9 illustrates the latch in the fully unlatched position in which the latch pawl 70 is inward of, and out of alignment with, the cabinet frame F.

When in the unlatched position, handle 10 is fully counterclockwise with respect to the latch body 30, as viewed looking in from the left in FIG. 9. The two opposite ends of outer cross pin 51 of shaft 50 are resting in the two low seats 21 of cam 20. Relative rotation between cam 20 and handle 10 is prevented by the presence of the projection 17 of handle 10 into the gap in the ring cam, and by engagement of lugs 14 of handle 10 in the notches 22 in the cam. In the unlatched position now being described, the cam-follower pin 51, relative to handle 10, is lying at a position 30° from the horizontal. At the same time, the ends of the motion-control pin 52, which pin is parallel to pin 51, are lying in the arcuate-shaped motion-control recesses 33 in the back of sleeve 31. In this unlatched position, shaft 50 is at its leftmost counter-clockwise limit of travel, as viewed looking in from the left in FIG. 9. The cap 15 is depressed within cavity 13 in handle 10, and latch pawl 70 is at a position which is 60° angularly removed from its angular latched position.

To latch the door D to the cabinet frame F, handle 10 is turned in the clockwise direction, as viewed looking in from the left in FIGS. 7–9. When this is done, handle 10 and shaft 50 first rotate as a unit. This unitary movement results primarily because the motion-control pin 52 cannot move axially relative to sleeve 31 until the ends of pin 52 are in alignment with the axial slots 35. This unitary movement is helped by the resistance to compression of spring 61, and by the steep rise on cam 20 at 23 (FIG. 8) which tends to prevent the cam follower pin 51 from being moved outwardly when the handle is turned. When handle 10 and shaft 50 move rotationally together, as just described, latch pawl 70 also moves rotationally.

After handle 10, shaft 50 and pawl 70 have been rotated as a unit through 60 degrees, pawl 70 is now at the angular position shown in FIG. 8, i.e. it is now aligned with frame F, although inward thereof. However, handle 10 still has an additional 120° to go. This additional 120° is used to obtain pull-up. The selection of 60° for the initial amount of pawl rotation is an arbitrary selection. This amount of rotation is sufficient to have pawl 70 clear the cabinet frame F when unlatched while still having sufficient handle rotation left over for the pull-up function. Also, after turning through 60°, shaft 50 has turned as far as it can because the ends of the motion-control cross pin 52 are now hitting the extended sides 135 of axial slots 35 in sleeve 31 as is illustrated in FIG. 8.

Further rotation of handle 10 beyond 60° now causes pure axial outward translation of shaft 50 and pawl 70. This is because the ends of the cam-follower cross pin 51 ride up the cam surfaces 23 of cam 20, causing the pin 51 to move outwardly and causing the ends of the motion-control cross pin 52 to move axially into slots 35. In the final latched position shown in FIG. 7, the ends of the cam-follower cross pin 51 rest on cam 20 at the high points identified 24. This is 120° from the initial position of the cam-follower pin 51 in seat 21 and somewhat beyond the peak points 25 of the cam. Thus, this is an over-the-center position which prevents handle 10 from turning back of its own accord.

The shape of the cam surface of cam 20 may be varied to suit different conditions. The particular shape shown and described in the present application is a presently preferred shape because it yields a mechanical function and a mechanical feel identical to an over-the-center toggle mechanism, having a rapid rise in the beginning and an increasing mechanical advantage towards the end.

In the latched position, shown in FIG. 7, shaft 50 cannot turn in either direction with respect to the latch body 30, and handle 10 can turn no further clockwise with respect to latch body 30 because the edge of handle sector 12 has come into contact with the edge of base sector 32.

The unlatching action is simply the reverse of that which has just been described. On unlatching, as handle 10 and cam 20 are turned counterclockwise, shaft 50 first translates axially inwardly and then rotates. These sequential motions are caused: (1) by the presentation of downward sloping cam surfaces to the opposite ends of cam-follower pin 51; (2) by the action of biasing spring 61 which urges shaft 50 inwardly; (3) by the axially-extending sides of the motion-control slots 35; and (4) by the lateral surfaces 133 of the sector motion-control recesses 33. These four factors force the axial and angular motions to take place in sequence, in response to turning the latch handle in the unlatching direction in one continuous motion. Rotation in the unlatching direction is brought to a stop by the abutment of arcuate sector 12 of the handle 10 against the arcuate sector 32 of escutcheon 30.

Cap 15 at the head end of shaft 50 is not an essential part of the latch. It fills the cavity 13 in the top of the handle 10. It could be pressed into the cavity in the handle to merely plug the hole. However, attaching it to the shaft 50 provides an additional benefit in that it serves as a visual indicator to the user of whether the latch is secured or released. When the cap is up, the latch is secured. When the cap is down, the latch is released.

The new latch has been described as mounted on the movable door. This is the preferred location. However, a latch embodying the basic concept of the present invention could be mounted on the fixed cabinet rather than on the door. In such case, the shaft and latch pawl would be moved angularly to engage a keeper mounted on the inside of the door and then axially inwardly to pull the door to tightly closed position. This is the reverse of the axial motion used to pull the door tightly shut when the latch is mounted on the door.

What is claimed is:

1. A latch having a pull-up action for developing a compressive force between a movable door and a fixed housing member, said latch comprising:

a. a latch body adapted to be mounted non-rotatably on a door;

b. said latch body including a sleeve adapted to project inwardly through an opening in said door;

c. an elongated shaft extending through and supported in said sleeve for axial and rotatable movement with respect thereto;

d. said shaft having a head portion and a threaded portion extending beyond said sleeve;

e. a latching pawl mounted on said threaded portion of said shaft for axial and angular movement with said shaft;

f. a rotatable handle having a cavity into which said head portion of said shaft extends;

g. a cam-follower cross pin carried by said head portion of said shaft;

h. an annular cam member within said handle cavity for rotatable movement with said handle, said cam having an annular cam surface having at 180° spacing two peak points, two low seats, and sloping surfaces therebetween, said low seats having steeply rising cam surfaces on both sides thereof;

i. spring means biasing said shaft axially in an unlatching direction, for maintaining said cam-follower pin in engagement with the camming surface of said cam;

j. a motion-control cross pin carried by said shaft on a portion thereof within said sleeve;

k. a pair of axially extending motion-control slots in said sleeve for receiving the opposite ends of said motion-control cross pin;

l. a pair of laterally extending arcuate motion-control recesses in said sleeve for receiving the opposite ends of said motion-control cross pin when said shaft is rotated;

m. the structural arrangement being such that when said rotatable handle and cam are at their limit positions in the latching direction, the opposite ends of said cam-follower cross pin are positioned on high portions of said cam surface just beyond said peak points, said shaft is in an outward position, said spring means is compressed, the opposite ends of said motion-control cross pin are within said axial motion-control slots of said sleeve and said latching pawl is in engagement with said fixed member, whereby said closure member is latched;

n. the structural arrangement being such that when said handle and cam are rotated in an unlatching direction from their limit latching positions, opposite ends of said cam-follower cross pin first pass said peak points on said cam surface and then move down sloping cam surfaces into the low seats, thereby permitting said spring-biased shaft to move axially in its biased direction, thereby moving opposite ends of said cam-follower cross pin through said axial motion-control slots to open ends thereof and into alignment with said lateral arcuate motion-control recesses; and o. the structural arrangement being such that further rotation of said handle and cam in an unlatching direction causes said steeply rising portions of said cam surfaces to engage opposite ends of said cam-follower cross pin, thereby to move said cam-follower pin rotationally, thereby to rotate said shaft on its axis and to cause opposite ends of said motion-control cross pin to enter into said lateral arcuate motion-control recesses, whereby said latching pawl is positioned out of alignment with said fixed member, thereby allowing opening of said door.

2. A latch according to claim 1 wherein:

a. a bushing supports said shaft in said sleeve;

b. said motion-control cross pin secures said bushing to said shaft;

c. said spring means is a compression spring embracing said shaft between said latch body and said bushing.

3. A latch according to claim 2 wherein;

a. a cap is placed over one end of said shaft;

b. said cam-follower cross pin secures said cap to said shaft.

4. A latch having a pull-up action for developing a compressive force between a movable door and a fixed cabinet, said latch comprising:

a. a shaft adapted to project through an opening in a door;

b. a latch body fixed mounted on said door adjacent said opening for supporting said shaft for axial and angular movement;

c. a latching pawl carried by said shaft;

d. a handle supported on an end portion of said shaft;

e. an annular cam carried by said handle, said cam having a surface having at least two peaks, at least two low seats, and sloping surfaces therebetween;

f. a cam-follower pin secured to and projecting laterally in both directions from said shaft;

g. means biasing said shaft axially for maintaining opposite ends of said cam-follower pin in engagement with said cam surfaces;

h. a motion-control pin mounted in fixed position on, and projecting laterally in both directions from, said shaft;

i. motion-control slots positioned axially in said latch body for receiving opposite ends of said motion-control pin for preventing angular movement of said shaft when ends of said control pin are within said motion-control axial slots;

j. motion-control recesses positioned angularly in said latch body for receiving said opposite ends of said motion-control pin and for preventing axial movement of said shaft when said ends of said control pin are within said recesses; and k. each of said motion-control slots and motion-control recesses intersecting, each of said slots having a sidewall which projects into its intersection and defines one end of one of said recesses, said sidewall functioning as a stop for angular movement of said control pin in said recess.

5. A latch according to claim 4 wherein said sloping cam surfaces are steeply inclined on each side of each of said low seats.

6. A latch having a pull-up action for developing a compressive force between a movable door member and a fixed member, said latch comprising:

a. a latch body adapted for non-rotatable mounting on one of said members, said latch body having a generally cylindrical bore substantially perpendicular to the surface of said one member;

b. a handle mounted for rotation at an outer end of said latch body, said handle having a generally cylindrical bore coaxial with said bore of said latch body;

c. a shaft disposed within and coaxial with said bore of said latch body and said bore of said handle, said shaft extending beyond said latch body;

d. means provided on one end of said shaft to engage said one member when said shaft is at a predetermined position of rotation about its axis;

e. means provided between said latch body and said shaft for transmitting motion from said handle to said shaft;

f. means provided between said latch body and said shaft for limiting both relative rotation and relative axial translation of said shaft with respect to said latch body and for preventing axial translation during rotation and preventing rotation during axial translation, the position of said shaft with respect to said latch body at one of the limits of rotation corresponding with the position of said shaft with respect to said latch body at one of the limits of axial translation, thereby to constitute a transitional position in the motion of said shaft with respect to said base; and g. means provided between said shaft and said handle for causing, in response to relative rotation of said handle with respect to said latch body, either rotation of said shaft with respect to said latch body or axial translation of said shaft with respect to said latch body, the motions being sequential as determined by the aforesaid limits of motion of said shaft with respect to said latch body.

7. The latch according to claim 6 wherein said means between said shaft and said handle for transmitting motion from said handle to said shaft includes a first cross pin passing through, at a right angle to, and near the outer end of, said shaft in engagement with an outwardly facing cam surface within said bore of said handle, a spring engaging said base and said shaft for biasing said shaft inwardly and maintaining engagement of said cross pin with said cam surface and of said handle with said latch body.

8. The latch according to claim 7 wherein said means between said latch body and said shaft limiting the motion of said shaft with respect to said latch body includes a second cross pin passing through said shaft, at a right angle to said shaft, and inward of said first cross pin, said second cross pin being in engagement with two diametrically opposed sector-shaped recesses which are provided on the inner end of said latch body communicating with two diametrically opposed axially outward extending slots which are provided within said bore of said latch body.

9. The latch according to claim 8 wherein one end of said shaft member is diametrically enlarged such as to substantially fill one end of said bore in said handle, thereby to serve as a visual indicator of the axial position of said shaft with respect to said handle.

10. The latch according to claim 9 wherein said diametrically enlarged end of said shaft is a separate cap member attached to said shaft by means of said first cross pin.

11. The latch according to claim 7 wherein said spring consists of a coiled compression spring encircling said shaft, within said bore of said latch body, the one end of said spring resting upon a radially extending step which is provided in said bore of said latch body and the other end of said spring resting upon an end of an annular bushing which is attached to said shaft by means of said second cross pin.

12. The latch according to claim 7 wherein said means provided on an end of said shaft to engage said fixed member consists of a radially extending pawl member adjustably attached to said shaft by means of nuts engaging threads on the surface of said shaft.

13. The latch according to claim 7 wherein the rotational motion of said handle with respect to said latch body is limited by means of sector-shaped projections on said handle engaging sector-shaped projections on said base.

14. In a pull-up latch mechanism in which a latch pawl is to be moved both rotationally and axially on its mounting shaft:

a. a fixed latch body having a generally cylindrical bore;
b. a shaft supported in said bore and projecting axially in both directions therefrom and having a latch pawl mounted on a shaft projection;
c. spring means biasing said shaft in one direction;
d. an annular cam mounted coaxially relative to said shaft;
e. a cam-follower cross pin secured to said shaft and maintained against said cam by said biasing means;
f. means for applying a torque force to said cam for moving said cam rotationally; and
g. means responsive to rotational movement of said cam for sequentially transmitting rotational and then axial motions to said shaft, in said order or in the reverse order, and for translating from the initial to the subsequent form of motion, all in response to rotational movement of said cam in one direction.

15. In a latch mechanism according to claim 14, wherein said means for sequentially transmitting rotational and axial motion to said shaft, in that order or in reverse order, includes:

a. a second cross pin secured to said shaft spaced axially from said first cross pin;
b. a pair of diametrically opposed axially extending slots in said latch body adapted to receive opposite ends of said second cross pin;
c. a pair of diametrically opposed laterally extending sector recesses in said latch body adapted to receive opposite ends of said second cross pin; and
d. the ends of said axial slots intersecting with the ends of said lateral recesses at a translation position.

16. In a latch mechanism according to claim 15 wherein said shaft is supported in said latch body by a bushing, and wherein said second cross pin secures said bushing to said shaft.

17. In a latch mechanism according to claim 16 wherein said biasing means is a coil compression spring which embraces said shaft and bears against said bushing at one end and against said fixed latch body at the other.

18. In a latch mechanism according to claim 17 wherein a cap is provided over one end of said shaft and is pinned to said shaft by said cam-follower cross pin.

19. In a latch mechanism according to claim 18 wherein said torque-force applying means is a handle having a cavity having an open end, wherein said cap is fitted within said handle cavity, and wherein the axial position of said cap relative to one end of said handle cavity is indicative of the axial position of said shaft.

20. In a latch mechanism according to claim 19 in which said biasing means urges said shaft in the unlatching direction.

21. In a pull-up latch mechanism in which a latch pawl is to be moved both rotationally and axially on its mounting shaft:

a. a latch body having an annular sleeve and a cylindrical bore;
b. a shaft supported in said sleeve and projecting in at least one direction therefrom and having a latch pawl mounted on said shaft projection for axial and rotational movement with said shaft;
c. a pair of diametrically opposed axially extending slots in said sleeve;
d. a pair of diametrically opposed laterally extending slots in said sleeve;
e. each of said axial slots intersecting with one of said lateral slots at a motion translation position;
f. a rotatable annular cam positioned coaxially relative to said shaft;
g. a cross pin secured to said shaft, opposite ends of said cross pin being maintained in engagement with said cam; and
h. means connected to said cam and responsive to torque force applied thereto for moving said cam rotationally, thereby, in response to said cam being moved rotationally in the same one direction, to transmit rotational and axial motions sequentially to said shaft, in that order or in reverse order depending upon the direction of rotation of said cam.

22. In a pull-up latch mechanism according to claim 21 wherein biasing means are provided for biasing said shaft in one direction for maintaining said opposite ends of said cross pin in engagement with said cam.

23. In a latch mechanism according to claim 22 in which said biasing means urges said shaft in the unlatching direction.

* * * * *